US006216522B1

(12) United States Patent
Crawley

(10) Patent No.: US 6,216,522 B1
(45) Date of Patent: Apr. 17, 2001

(54) TOOL FOR INSTALLING A TURN VANE

(76) Inventor: Timothy M. Crawley, 5822 W. Purdue Ave., Glendale, AZ (US) 85302

( * ) Notice: Subject to any disclaimer, the term of this patent is extended or adjusted under 35 U.S.C. 154(b) by 0 days.

(21) Appl. No.: 09/429,061

(22) Filed: Oct. 29, 1999

(51) Int. Cl.[7] ..... B21D 28/14; B21D 28/10; B21D 39/02

(52) U.S. Cl. ..... 72/325; 29/513; 29/566.1; 72/479

(58) Field of Search ..... 72/325, 479; 29/513, 29/21.1, 566, 566.1

(56) References Cited

U.S. PATENT DOCUMENTS

| | | | | |
|---|---|---|---|---|
| 2,087,186 | | 7/1937 | Freeman, Jr. . | |
| 2,626,687 | * | 1/1953 | Williams | 29/21.1 |
| 3,040,326 | | 6/1962 | De Caro . | |
| 3,222,779 | * | 12/1965 | Zinniger | 29/566 |
| 3,411,339 | * | 11/1968 | Brown | 72/325 |
| 4,404,835 | * | 9/1983 | Frith | 72/325 |
| 5,022,253 | | 6/1991 | Parlatore | 72/325 |
| 5,068,957 | * | 12/1991 | Felson | 29/566 |
| 5,202,524 | * | 4/1993 | Nechushtan | 29/513 |
| 5,323,632 | * | 6/1994 | Shirasaka | 72/325 |
| 5,327,631 | | 7/1994 | Lincavage | 29/271 |
| 5,377,519 | | 1/1995 | Hayashi | 72/326 |
| 5,495,649 | | 3/1996 | Long | 29/275 |

* cited by examiner

*Primary Examiner*—Daniel C. Crane
(74) *Attorney, Agent, or Firm*—Kenneth L. Tolar

(57) ABSTRACT

A tool for installing a turn vane within air conditioning duct work includes an octagonal shaft having a cutting head at an end thereof. The cutting head includes a pair of spaced parallel outer blades each having a downwardly angled cutting surface. Disposed between the outer blades is an oppositely facing inner blade likewise having a downwardly sloping cutting surface. A second embodiment includes a shaft adapted to be used with an air driven hammer. When force is applied to the shaft with either a conventional or air driven hammer, oppositely directed, severed portions are created on the turn vane thereby securing it to a turn vane rail.

8 Claims, 2 Drawing Sheets

TOOL FOR INSTALLING A TURN VANE

BACKGROUND OF THE INVENTION

The present invention relates to a tool for assisting a worker in installing turn vanes within air conditioning duct work.

DESCRIPTION OF THE PRIOR ART

Air conditioning duct work often includes 90 degree elbows and similar sharp turns within which turn vanes are installed to more efficiently to direct air through the duct. The turn vanes are secured to a plate referred to as a turn vane rail which is then mounted within the duct. Securing the turn vane to the rail is cumbersome and difficult. Each vane includes rows of aligned indentions each having a slit therethrough. An edge of the turn vane is inserted through the slit and the protruding portion is bent with a screwdriver or other tool thereby securing the vane to the rail. Various tools for securing the turn vane exist, most of which are complicated, include numerous parts or are awkward and cumbersome to use. The present invention provides an easy to use and inexpensive to manufacture tool that, when forced against the protruding portion of the turn vane, cuts and bends the edge of the vane in opposite directions thereby securing the vane to the rail. Various tools exist in the prior art. For example, U.S. Pat. No. 5,495,649 issued to Long discloses a tool for separating a pair of oppositely disposed spot-welded sheet metal panels.

U.S. Pat. No. 5,377,519 Hayashi discloses a punch and die for forming a protrusion and a pair of slits in sheet material to separate a product therefrom.

U.S. Pat. No. 5,327,631 issued to Lincavage discloses a roll pin punch kit apparatus including a plurality of roll pin punches in association with an elongated handle that are mounted for ease of assembly within a container structure.

U.S. Pat. No. 5,022,253 issued to Parlatore discloses a hand-held punch plier.

U.S. Pat. No. 3,040,326 issued to DeCaro discloses a fastener device.

U.S. Pat. No. 2,087,186 issued to Freeman, Jr. discloses a punch.

Although the prior art discloses numerous tools, none relate to a device for securing a turn vane to a turn vane rail.

SUMMARY OF THE INVENTION

The present invention relates to a tool for securing a turn vane to a turn vane rail. The device comprises an octagonal shaft having a cutting head at the top end thereof. The cutting head includes a pair of spaced outer blades each having a downwardly angled cutting surface with an oppositely facing inner blade disposed therebetween. The inner blade also includes a downwardly angled cutting surface. A second embodiment is designed to be attached to a power tool such as an air driven hammer. When the cutting head is pressed against a turn vane with a predetermined amount of force, an edge of the vane is cut twice and bent in opposite directions thereby securing the vane to the vane rail. It is therefore an object of the present invention to provide a tool for attaching a turn vane that is easy-to-use and inexpensive-to-manufacture.

It is another object of the present invention to provide a tool for attaching a turn vane that may be interchangeably used with a conventional hammer or an air driven hammer.

It is yet another object of the present invention to provide a tool for securing a turn vane that quickly and conveniently secures a turn vane to a turn vane rail.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
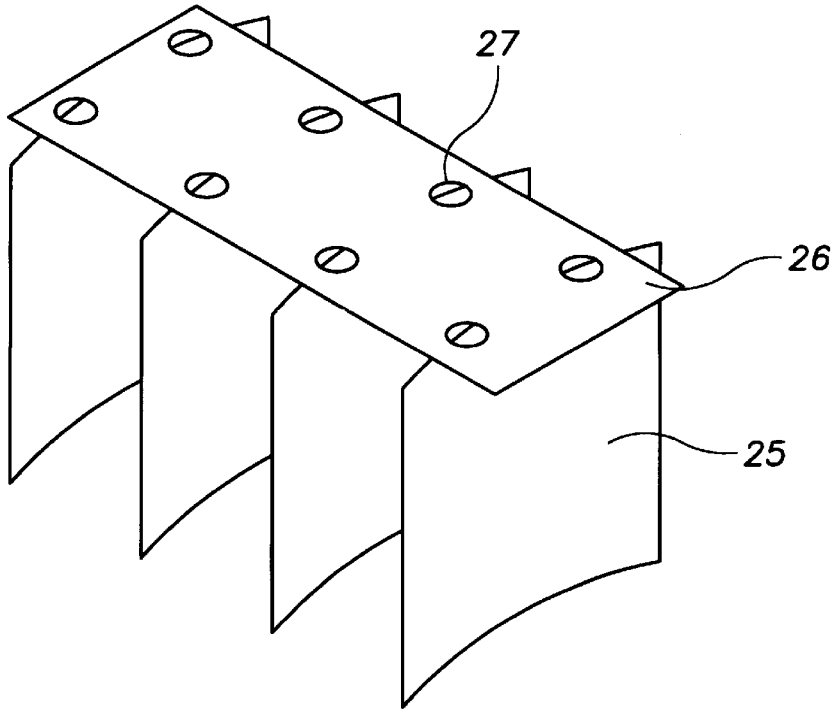
FIG. 1 depicts a plurality of turn vanes secured to a turn vane rail.

Referring to FIG. 1, a turn vane 25 typically includes an upper and a lower edge each of which is secured to a turn vane rail 26. The rail is then secured within an air conditioning duct. The rail includes two or more aligned rows of depressions 27 each having a slit therein. An edge of the turn vane is inserted into one or more of the slits. The portion of the edge extending through the slit and into the depression is then bent or deformed to secure the vane to the vane rail.

Figure 2:
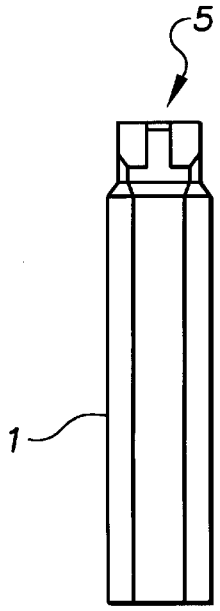
FIG. 2 is a front view of a first embodiment.
Figure 3:
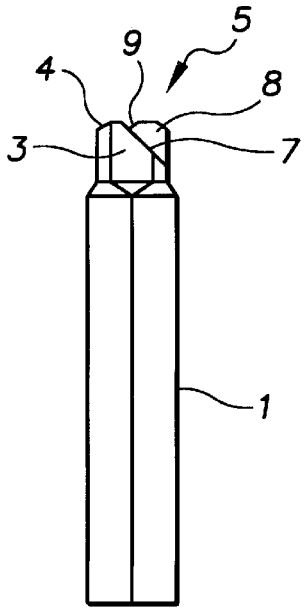
FIG. 3 is a side view of the first embodiment.
Figure 4:
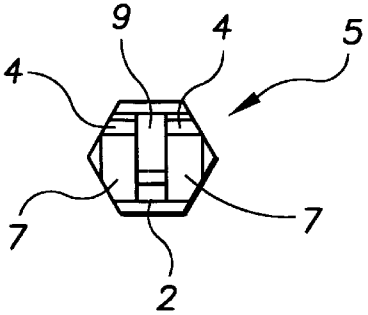
FIG. 4 is a top view of the first embodiment.

The present invention relates to a tool for conveniently cutting and bending the portion of the turn vane edge extending into the depression. Referring now to FIGS. 2 through 4, a first embodiment includes an octagonal shaft 1 having an upper end and a lower end. At the upper end is a cutting head 5 for creating a uniquely configured cut on a turn vane. The cutting head includes a pair of parallel spaced outer blades 3 each having a contoured upper portion 4 with a downwardly sloped cutting surface 7 extending therefrom. Disposed between the outer blades is an oppositely facing inner blade 8 likewise having a contoured upper portion 2 and a downwardly sloped cutting surface 9. Each cutting surface includes two opposing sharp edges for severing the edge of the turn vane when thrust thereagainst. In the preferred embodiment, the cutting surface slopes approximately 35 degrees relative to a horizontal plane. Also in the preferred embodiment, the blades are spaced approximately 0.01 inches with a tolerance of 0.001 inches. However, as will be readily apparent to those skilled in the art, the blade spacing, tolerance and angle of the cutting surface may be varied to suit a particular application.

Figure 5:
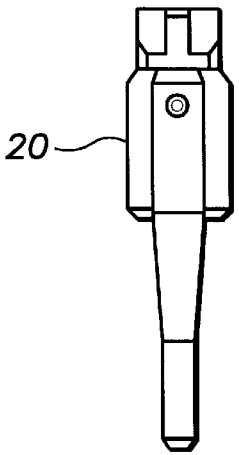
FIG. 5 is a front view of a second embodiment.
Figure 6:
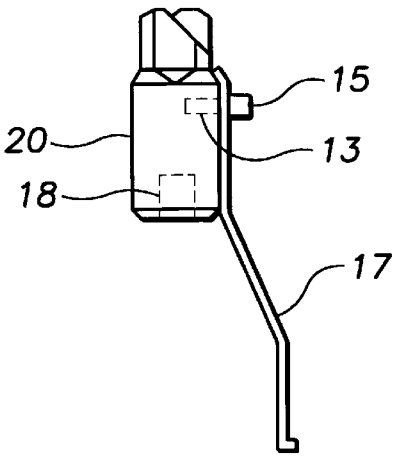
FIG. 6 is a side view of the second embodiment.

Now referring to FIGS. 5 and 6, a second embodiment is provided for use with a power tool such as an air driven hammer. The device includes a shorter cylindrical shaft 20 having a cuffing head, similar to that as described above, at the upper end thereof. The lower end of the cylindrical shaft includes a hollow bore 18 for receiving the operating tip of an air hammer. On a side wall of the shaft is a threaded bore 13 for receiving a fastener means such as a screw 15 to fasten a retaining clip 17 that secures the tool to the air powered hammer.

Figure 7:
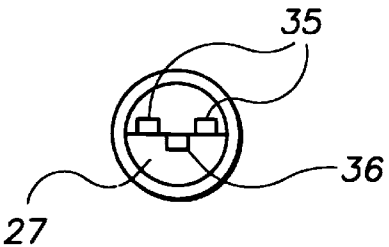
FIG. 7 depicts the bent portions of a turn vane that are formed by the present invention.

To use the above described device, an edge of a turn vane is inserted into one or more slits with a portion extending into the depression. The cutting head of the hand held version is placed against the protruding portion of the turn vane and the opposing end is struck with a hammer or other similar blunt object. Accordingly, the tool will cut the edge twice to form three separate portions, a pair 35 of which are spaced and bent in a first direction with a third portion 36 between the spaced portions and bent in an opposite direction as depicted in FIG. 7. To use the second embodiment, the cylindrical shaft is attached to the tip of an air hammer. When the air hammer is activated, a similar cut will be created on the turn vane.

The above described tools are preferably constructed with steel. However, as will be readily apparent to those skilled in the art, size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tool for securing a turn vane to a turn vane rail comprises:

an elongated shaft having a top end and a bottom end;

a cutting head at the top end of said shaft, said cutting head including a pair of spaced parallel outer blades each having a downwardly sloped cutting surface, and an inner cutting blade disposed between said outer blades, said inner blade likewise having a downwardly sloping cutting surface facing in a direction opposite the cutting surfaces of said outer blades.

2. A device according to claim 1 wherein said shaft is octagonal.

3. A device according to claim 1 wherein said cutting surfaces are sloped at a substantially thirty-five degree angle relative to a horizontal plane.

4. A device according to claim 1 wherein said inner blade is spaced approximately 0.01 inches from each of said outer blades.

5. A tool for securing a turn vane to a turn vane rail comprises:

a shaft having an upper end and a lower end;

a cutting head at the upper end of said shaft, said cutting head including a pair of spaced parallel outer blades each having a downwardly sloped cutting surface, and an inner cutting blade disposed between said outer blades, said inner blade likewise having a downwardly sloping cutting surface facing in a direction opposite the cutting surface of said outer blade;

a bore at the lower end of said shaft for receiving a power tool tip.

6. A device according to claim 5 wherein said shaft further comprises:

a retaining clip attached to said shaft for retaining said shaft on a power tool.

7. A device according to claim 5 wherein each of said cutting surfaces is sloped at a substantially thirty-five degree angle relative to a horizontal plane.

8. A device according to claim 5 wherein said inner blade is spaced approximately 0.01 inches from each of said outer blades.

* * * * *